US009309694B2

(12) United States Patent
Prater

(10) Patent No.: US 9,309,694 B2
(45) Date of Patent: Apr. 12, 2016

(54) PIN TUMBLER LOCK PICK KIT AND METHOD OF USE

(71) Applicant: Stephen Kirk Prater, Edgewater, FL (US)

(72) Inventor: Stephen Kirk Prater, Edgewater, FL (US)

(73) Assignee: CAP POPPER, LLC, Palm Bay, FL (US)

( * ) Notice: Subject to any disclaimer, the term of this patent is extended or adjusted under 35 U.S.C. 154(b) by 0 days.

(21) Appl. No.: 14/329,304

(22) Filed: Jul. 11, 2014

(65) Prior Publication Data

US 2016/0010360 A1 Jan. 14, 2016

(51) Int. Cl.
*E05B 19/20* (2006.01)

(52) U.S. Cl.
CPC ..... *E05B 19/20* (2013.01); *E05B 19/205* (2013.01); *Y10T 70/7797* (2015.04)

(58) Field of Classification Search
CPC .... Y10T 70/7797; E05B 19/20; E05B 19/205
USPC ..... 70/394, 378; 29/270–272, 804; 81/15.9, 81/488; 33/540
See application file for complete search history.

(56) References Cited

U.S. PATENT DOCUMENTS 1,403,753 A * 1/1922 Epstein ..... B21J 15/383 70/394
1,977,362 A * 10/1934 Wakstein ..... B25D 5/00 101/3.1
4,667,494 A * 5/1987 Joosten ..... E05B 19/205 33/540
5,325,691 A * 7/1994 Embry ..... E05B 19/205 33/540
6,138,486 A * 10/2000 Hughes ..... E05B 19/20 70/394
6,148,652 A * 11/2000 Magini ..... E05B 19/20 33/540
6,151,936 A * 11/2000 Randall ..... E05B 19/20 29/426.1
7,895,763 B2 * 3/2011 Capehart ..... G01B 5/0018 33/540
8,001,816 B2 * 8/2011 Black ..... E05B 19/20 70/394
8,776,561 B1 * 7/2014 Jones ..... E05B 19/20 70/394

* cited by examiner

*Primary Examiner* — Suzanne Barrett

(57) ABSTRACT

A pin tumbler lock pin kit and method of use. According to an embodiment, pin tumbler lock pick kit 10 is generally comprised of a pin lifter 100, a tailpiece manipulator 200, a first guide key 300, a second guide key 400, and a J-hook 500. The present disclosure enables homeowners and professional locksmiths to easily open pin tumbler locks without damaging the lock, without practice or locksmith experience, and in a significant reduced time compared to prior art solutions (typically in 60 seconds or less). Embodiments of the present disclosure enable a user to mechanically manipulate the tumbler pins of a pin tumbler lock, and remove the retaining cap that retains the tumbler pins. With the retaining cap removed the lock set can easily be turned and opened without incurring any damage to the lockset. The unlocked tumbler can be removed and re-keyed for reuse.

3 Claims, 7 Drawing Sheets

PIN TUMBLER LOCK PICK KIT AND METHOD OF USE

RELATED APPLICATIONS

This application claims the benefit of U.S. Provisional Application 61/876,207, filed Sep. 10, 2013, hereby incorporated by reference.

FIELD

The present disclosure relates to the field of lock picks, in particular, a novel pin tumbler lock pick kit and method of use.

BACKGROUND

One of the more popular types of mechanical locks is referred to as the pin-tumbler lock or pin-tumbler cylinder lock. Pin-tumbler cylinders are used in a great variety of locks including padlocks, door locks, automobile vehicle locks, and in specialty locks. This type of lock is so well known and widely used that a detailed description is unwarranted. Generally, the lock comprises a cylinder which receives a plug the rotation of which opens or closes the lock. The plug carries a plurality of pins that are slidably received in lateral passages. The pins are spring-biased to the closed position. The pins are of different lengths and, therefore, align with the open position only when the proper key is inserted. When the proper key is inserted, the pins are positioned so that they do not extend into the cylinder nor do pins mounted in the cylinder extend into the plug. In this position, and only in this position, do the pins permit rotation of the plug and, consequently, the opening of the lock.

Lock picks are also well known. Lock picks come in a variety of sizes and shapes and are useful for different kinds of locks. One of the more common kinds of lock picks is used for the pin-tumbler type of lock. One type of lock pick for the pin-tumbler type of lock uses a small flat tool with one or more projections thereon and a tension tool. As the tension tool is used to turn the plug, or exert a turning force on the plug, the pick is inserted into the lock and moved forwardly and backwardly along the plug pushing the pins up. By careful manipulation, the pins will align themselves to the open position and the tension will keep them in the open position until all of them are aligned and the lock opens.

Prior art lock picks have been known for a very long time and are known in a variety of sizes, shapes, and assemblies. Despite being well known in concept, prior art lock pick solutions either require a skilled user and significant manipulation of the lock, and/or damage the lock such that it cannot be readily reused after being manipulated. What is needed, therefore, is a lock pick solution that enables quick and effective manipulation of a tumbler lock by a novice user, while also preserving the lock to be rekeyed and reused after being picked.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An object of the present invention is a pin tumbler lock pick kit comprising a guide key apparatus, the guide key apparatus comprising an angled first surface, the angled first surface extending from a lower portion to an upper portion, a shoulder stop adjacent to an approximate midpoint of the angled first surface, the shoulder stop having a milling configured to align the upper portion of the angled first surface with a first pin aperture of a pin tumbler lock, and a key blade extending from the shoulder stop to a key tip, the key blade having a substantially smooth upper surface, at least one side surface, and at least one milling disposed upon the at least one side surface, the at least one milling configured to align the key blade with a key cylinder of a pin tumbler lock; a pin lifter apparatus comprising a substantially cylindrical handle having a top portion and a substantially flat bottom portion, and an elongated wire portion coupled to the top portion of the substantially cylindrical handle, the elongated wire portion having an angled tip; and, a pin remover apparatus having a handle portion and a substantially J-shaped pick.

Another object of the present invention is pin tumbler lock pick kit comprising a guide key apparatus, the guide key apparatus comprising an angled first surface, the angled first surface extending from a lower portion to an upper portion, a shoulder stop adjacent to an approximate midpoint of the angled first surface, the shoulder stop having a milling configured to align the upper portion of the angled first surface with a first pin aperture of a pin tumbler lock, and a key blade extending from the shoulder stop to a key tip, the key blade having a substantially smooth upper surface, at least one side surface, and at least one milling disposed upon the at least one side surface, the at least one milling configured to align the key blade with a key cylinder of a pin tumbler lock; a pin lifter apparatus comprising a substantially cylindrical handle having a top portion and a substantially flat bottom portion, and an elongated wire portion coupled to the top portion of the substantially cylindrical handle, the elongated wire portion having an angled tip; a pin remover apparatus having a handle portion and a substantially J-shaped pick; and, a tail piece manipulator apparatus having a handle portion and an elongated wire portion coupled to the handle portion.

Another object of the present invention is a method of unlocking a pin tumbler lock comprising inserting a guide key into a key cylinder of a pin tumbler lock, the guide key having an angled first surface extending from a lower portion to an upper portion, and a shoulder stop configured to align the upper portion of the angled first surface with a first pin aperture of the pin tumbler lock, aligning a pin lifter with the key cylinder of the pin tumbler lock using the guide key, the pin lifter having an elongated wire portion, inserting the elongated wire portion of the pin lifter into the key cylinder in contact with the guide key, such that the elongated wire portion is inserted into the first pin aperture of the pin tumbler lock; applying force to the pin lifter sufficient to dislodge a retaining cap of the pin tumbler lock; removing the pin lifter and the guide key from the key cylinder; inserting a substantially J-shaped pick into the key cylinder; applying upward force to the substantially J-shaped pick sufficient to dislodge a plurality of lock pins in the pin tumbler lock; and, turning the key cylinder to a desired position.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 1:
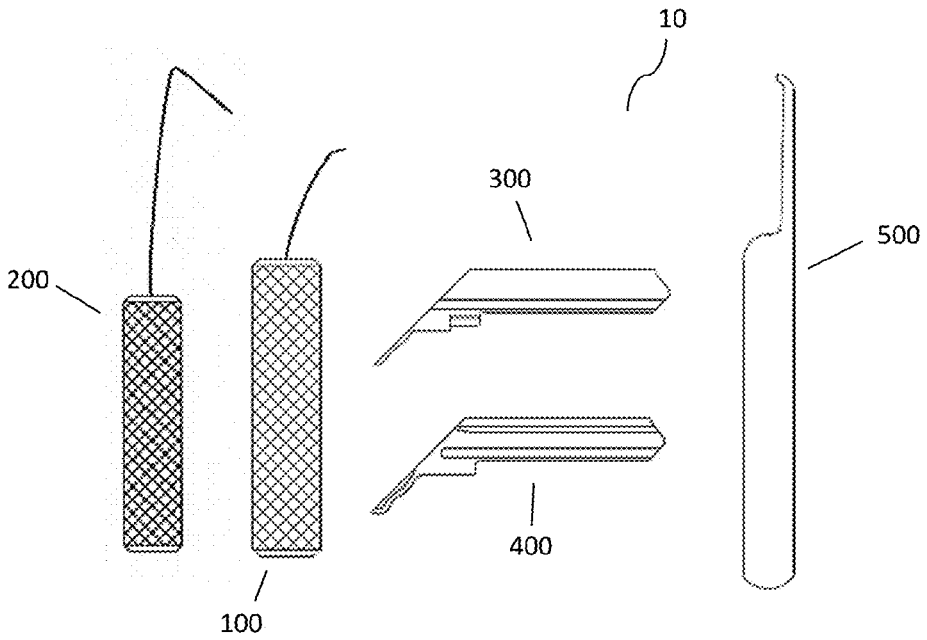
FIG. 1 is a perspective view of a pin tumbler lock pick kit.

Exemplary embodiments are described herein to provide a detailed description of the present disclosure. Variations of these embodiments will be apparent to those of skill in the art. Moreover, certain terminology is used in the following description for convenience only and is not limiting. For example, the words "right," "left," "top," "bottom," "upper," "lower," "inner" and "outer" designate directions in the drawings to which reference is made. The word "a" is defined to mean "at least one." The terminology includes the words above specifically mentioned, derivatives thereof, and words of similar import.

The present disclosure provides embodiments for a novel lock pick kit and associated methods of use. The present disclosure enables homeowners and professional locksmiths to easily open pin tumbler locks without damaging the lock, without practice or locksmith experience, and in a significant reduced time compared to prior art solutions (typically in 60 seconds or less). Embodiments of the present disclosure enable a user to mechanically manipulate the tumbler pins of a pin tumbler lock, and remove the retaining cap that retains the tumbler pins. With the retaining cap removed, the lock set can easily be turned and opened without incurring any damage to the lockset. The unlocked tumbler can be removed and re-keyed for reuse.

Figure 2A:
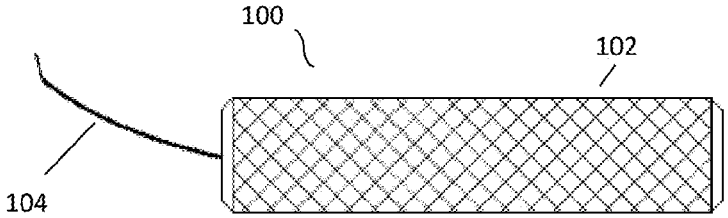
FIG. 2*a* is a side perspective view of a pin lifter apparatus.
Figure 2C:
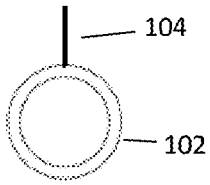
FIG. 2*c* is a bottom perspective view of a pin lifter apparatus.
Figure 2B:
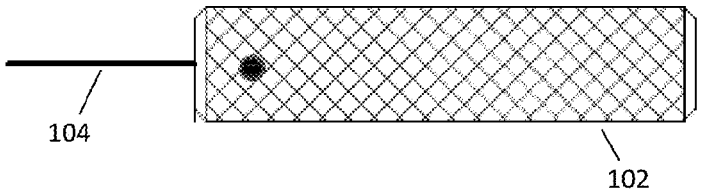
FIG. 2*b* is an alternate side perspective view of a pin lifter apparatus.

According to a preferred embodiment, FIG. 1 is a perspective view of a pin tumbler lock pick kit. A pin tumbler lock pick kit 10 is generally comprised of a pin lifter 100, a tailpiece manipulator 200, a first guide key 300, a second guide key 400, and a J-hook 500. Pin lifter 100, as shown in FIGS. 2*a-c*, is generally comprised of a handle 102 and a wire pin lifter 104. According to an embodiment, handle 102 is made of machined aluminum and has an outside diameter in the range of about ½ inch to about 1 inch, and a length in the range of about 3 inches to about 6 inches. A wire drive hole may be drilled in a top portion of the handle to receive wire pin lifter 104, and may include a stainless steel set screw in the side of handle 102 to couple wire pin lifter 104 to handle 102. Handle 102 may have a textured surface to improve the user's grip when held in the user's hand, and may have a substantially flat bottom. It is anticipated that handle 102 may be made of any commercially reasonable materials such as steel, plastic, wood, and the like.

Wire pin lifter 104 may be made of any substantially rigid wire, such as steel or aluminum wire, and should be a small enough gauge to fit into a pin aperture of a pin tumbler lock; for example, in the range of about 30 gauge to about 15 gauge. Wire pin lifter 104 may be curved in the range of about 30 degrees to about 60 degrees, and may have a bent tip. The bent tip may be approximately ¼ inch to 1 inch long, and may be bent at an angle in the range of about 30 degrees to about 90 degrees.

Figure 3A:
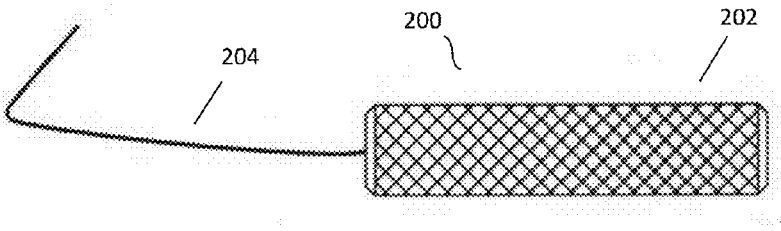
FIG. 3*a* is a side perspective view of a tail piece manipulator apparatus.
Figure 3C:
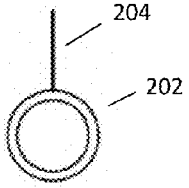
FIG. 3*c* is a bottom perspective view of a tail piece manipulator apparatus.
Figure 3B:
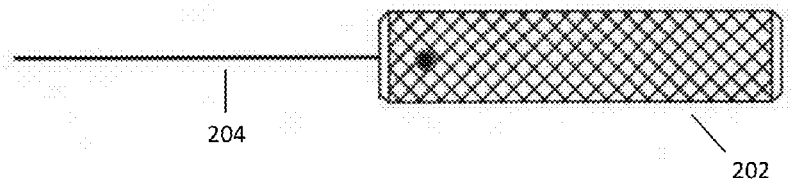
FIG. 3*b* is an alternate side perspective view of a tail piece manipulator apparatus.

FIGS. 3*a-c* show perspective views of a tail piece manipulator apparatus 200. According to an embodiment, tail piece manipulator apparatus is generally comprised of a handle 202 and a tailpiece wire 204. Handle 202 may be made of machined aluminum and may have an outside diameter in the range of about ½ inch to about 1 inch, and a length in the range of about 3 inches to about 6 inches. A wire drive hole may be drilled in the top of the handle to receive tailpiece wire 204, and may include a stainless steel set screw in the side of handle 202 to couple tailpiece wire 204 to handle 202. Handle 202 may have a textured surface to improve the user's grip when held in the user's hand, and may have a substantially flat bottom. It is anticipated that handle 202 may be made of any commercially reasonable materials such as steel, plastic, wood, and the like.

Tailpiece wire 204 may be made of any substantially rigid wire, such as steel or aluminum wire, and should be a small enough gauge to fit into a door handle aperture; for example, in the range of about 30 gauge to about 15 gauge. Tailpiece wire 204 may be made of a length of substantially rigid wire in the range of about 4 inches to about 10 inches. A first end of tailpiece wire 204 may be coupled to an upper portion of handle 202. A tip of tailpiece wire 204, having a length in the range of about ½ inch to about 2 inches, may be bent upward in a range of about 105 degrees to about 150 degrees, forming an acute angle. The tip of tailpiece wire 204 is inserted into a door handle aperture to engage with a tumbler lock tailpiece during use.

According to a preferred embodiment, pin tumbler lock pick kit 10 has a two guide keys. In a preferred embodiment, first guide key 300 fits KWIKSET-brand pin tumbler lock cylinders, and second guide key 400 fits SCHLEGE-brand pin tumbler lock cylinders. While this embodiment includes guide keys configured to fit specific lock brands, the brand of lock is incidental to the inventive aspects of the present disclose, and is merely illustrative of the desired functionality of the guide keys.

Figure 4A:
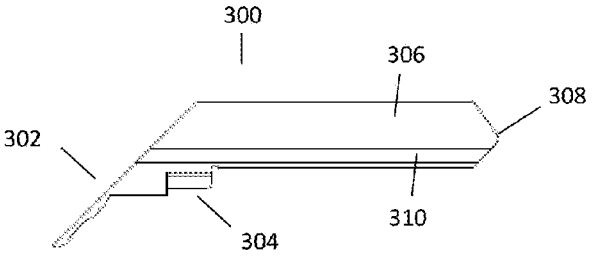
FIG. 4*a* is a broad side perspective view of a first guide key.
Figure 4B:
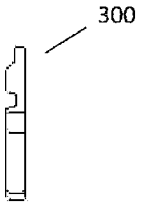
FIG. 4*b* is a front profile perspective view of a first guide key.
Figure 7A:
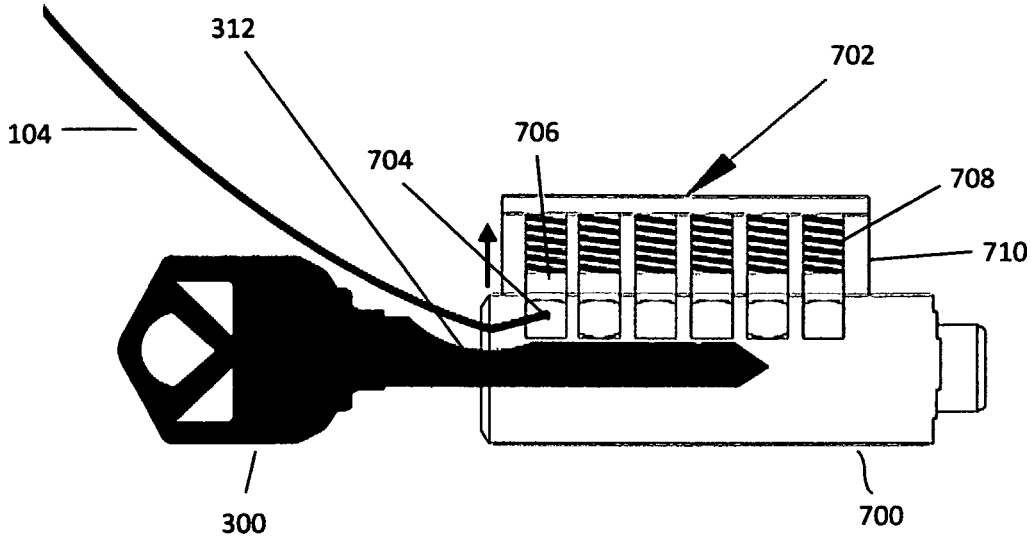
FIG. 7*a* is a perspective view of a pin tumbler lock pick set in use.
Figure 7B:
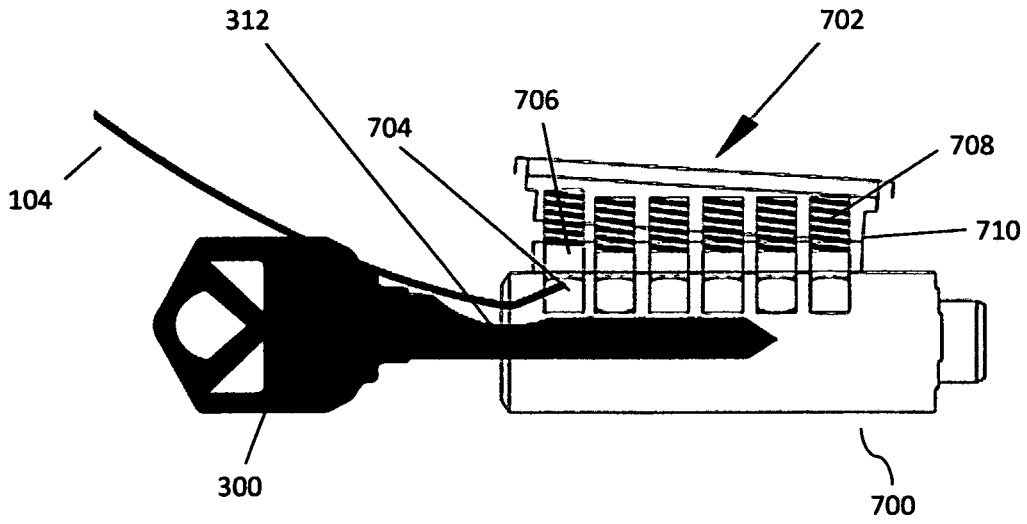
FIG. 7*b* is a perspective view of a pin tumbler lock pick set in use with a tumbler cap in a disengaged position.

FIG. 4*a* is a broad side perspective view of a first guide key 300 showing key blade 306. FIG. 4*b* is a front profile perspective view of a first guide key showing the perspective from key tip 308 to inclined surface 302. According to an embodiment, guide key 300 has an inclined surface 302. Inclined surface 302 may be defined by a notch 312 in a key head (as shown in FIGS. 7*a* and 7*b*). Key blade 306 should substantially define the overall length of guide key 300, and may extend from inclined surface 302 to key tip 308. Key blade 306 may have a smooth upper surface to enable it to slide freely into a key cylinder. Key tip 308 is inserted into a key cylinder of a pin tumbler lock, such that shoulder stop 304 makes contact with a face of the key cylinder. Shoulder stop 304 is designed to align an upper portion of inclined surface 302 with a first pin aperture of the pin tumbler lock. First guide key 300 has a milling 310 on key blade 306 such that guide key 300 fits the key cylinder of a KWIKSET-brand pin tumbler lock. Milling 310 can be configured to correspond with any brand of pin tumbler lock, including KWIKSET, SCHLAGE, BALDWIN, OMNIA, WEISER, WESLOCK, YALE, and the like. The only significance in specifying specific lock brands is to merely illustrate that the width, depth, length, and pattern of milling 310 will be different in alternative embodiments to correspond with the shape of the key cylinder of different brands of pin tumbler locks.

Figure 5A:
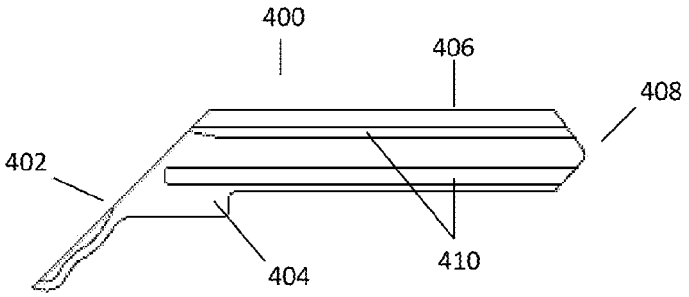
FIG. 5*a* is a broad side perspective view of a second guide key.
Figure 5B:
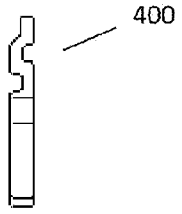
FIG. 5*b* is a front perspective view of a second guide key.

FIG. 5*a* is a broad side perspective view of a first guide key 400 showing key blade 406. FIG. 5*b* is a front profile perspective view of a first guide key showing the perspective from key tip 408 to inclined surface 402. According to an embodiment, guide key 300 and guide key 400 are substantially the same in form and function, except milling 410 is designed to be inserted into a SCHLAGE-brand key cylinder, where milling 310 is designed to be inserted into a KWIKSET-brand key cylinder.

Guide key 400 has an inclined surface 402. Inclined surface 402 may be defined from a notch by a substantially V-shaped notch in a key head. Key blade 406 should substantially define the overall length of guide key 400, and may extend from inclined surface 402 to key tip 408. Key blade 306 may have a smooth upper surface to enable it to slide freely into a key cylinder. Key tip 408 is inserted into a key cylinder of a pin tumbler lock, such that shoulder stop 404 makes contact with a face of the key cylinder. Shoulder stop 404 is designed to align an upper portion of inclined surface 402 with a first pin aperture of the pin tumbler lock. First guide key 400 has a milling 410 on key blade 406 such that guide key 400 fits the key cylinder of 10 a SCHLAGE-brand pin tumbler lock. Milling 410 can be configured to correspond with any brand of pin tumbler lock, including KWIKSET, SCHLAGE, BALDWIN, OMNIA, WEISER, WESLOCK, YALE, and the like. The only significance in specifying specific lock brands is to merely illustrate that the width, depth, and length of milling 410 will be different in alternative embodiments to correspond with the shape of the key cylinder of different brands of pin tumbler locks.

Figure 6:
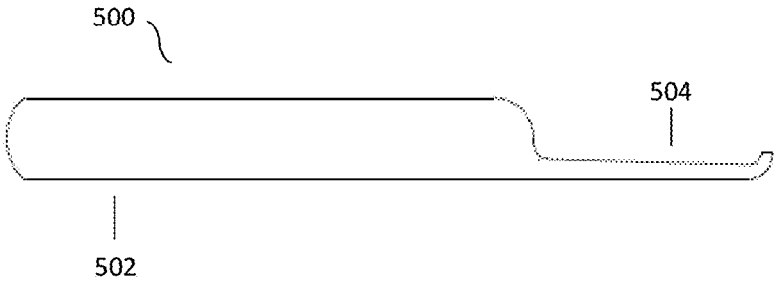
FIG. 6 is a side perspective of a J-pick.

FIG. 6 is a side perspective of a J-pick 500 in lock pick kit 10. A J-pick 500 may be made of stamped, pressed, or scrolled sheet metal, such as steel, aluminum, iron and the like. The gauge of the sheet metal should be a small enough to fit into a key cylinder of a pin tumbler lock; for example, in the range of about 30 gauge to about 15 gauge. J-pick 500 may have a handle 502 and a pick 504. J-pick 500 may have an overall length in the range of about 3 inches to about 7 inches. Handle 502 may have a height in the range of about ¼ inch to about ¾ inch, and a length in the range of about two inches to about 5 inches. Pick 504 may have a height in the range of about 1/10 inch to about 3/10 inch, and a length in the range of about 1 inch to about 3 inches. Pick 504 may have a curved end portion defining a pick, the curved end portion having an overall height in the range of about 1/10 inch to about 4/10 inch.

FIGS. 7*a*-8*b* show embodiments of lock pick kit 10 in use on a pin tumbler lock 700 and a door handle with pin tumbler 800. FIG. 7*a* is a perspective view of a guide key 300 and a pin lifter 100 engaged with a first pin aperture of a tumbler lock; and, FIG. 7*b* is a perspective view of a guide key 300 and a pin lifter 100 with tumbler lock cap 702 in a disengaged position.

Referring now to FIG. 7*a*, pin tumbler lock 700 is in a locked position. Pin tumbler lock 700 is comprised of pin tumbler 710 and a key cylinder 712. Pin tumbler 710 comprises a plurality of pin apertures or lateral passages 704, each pin aperture 704 housing a pin 706 and a spring 708, and being held in place by a tumbler cap 714. Springs 708 hold pins 706 in a desired position. Guide key 300 is inserted into key cylinder 712 such that inclined surface 302 is aligned with first pin aperture 704. Guide key 300 is used in FIGS. 7*a* and 7*b* for illustrative purposes, but could be readily substituted for guide key 400 depending on the type of lock and milling of guide key. Wire pin lifter 104 is inserted into first pin aperture 704 using inclined surface 302 as a guide to align the tip of wire pin lifter 104 with first pin aperture 704. Guide key 300 enables the user to align the tip of wire pin lifter 104 with first pin aperture 704 typically in 30 seconds or less. Once wire pin lifter 104 is inserted into first pin aperture 704, the user applies force to wire pin lifter 104, typically by striking the substantially flat bottom of handle 102 with a hammer. This force will push pin 706 upward against spring 708, which in turn will apply pressure against tumbler cap 714. User should apply sufficient force to wire pin lifter 104 to dislodge tumbler cap 714, as shown in FIG. 7*b*. Once tumbler cap 714 is dislodged, pins 706 and springs 708 are no longer secured in pin apertures 704. User can then use wire pin lifter 104 or J-hook 500 to dislodge the pins from their positions. If the user dislodges the pins with J-hook 500, pick 504 should be inserted into key cylinder 712 with the curved end facing pin apertures 704. The user should slide the curved end of pick 504 against pin apertures 704, such that pick 504 dislodges the remaining pins 706. Once pins 706 are dislodged, key cylinder 712 may be turning using handle 502 to rotate the lock to an unlocked position.

Figure 8A:
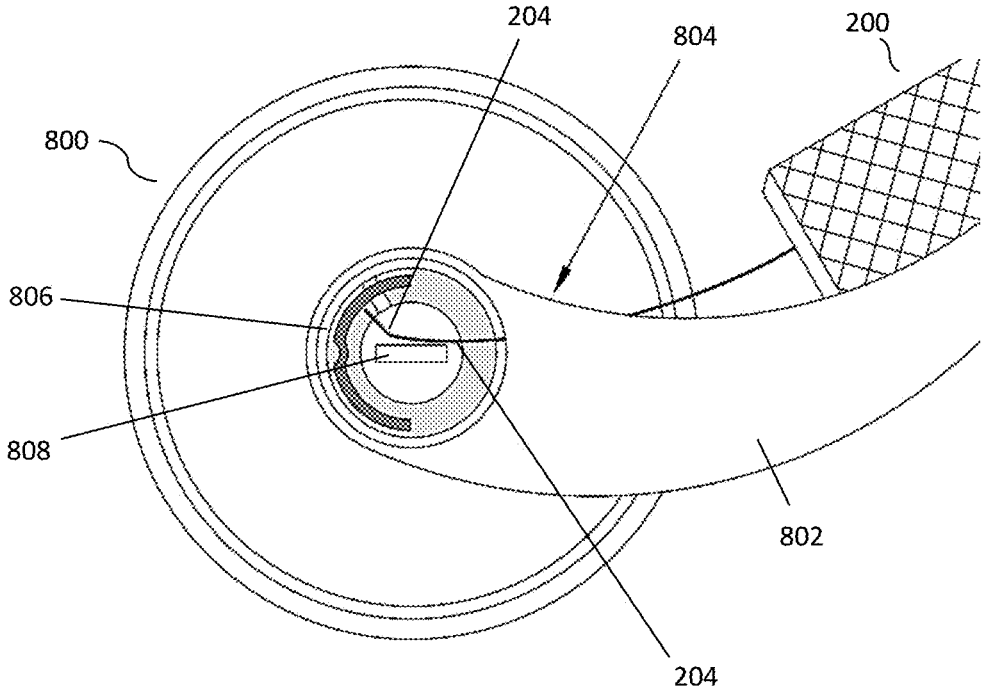
FIG. 8*a* is a perspective view of a tail piece manipulator inserted into a tumbler in a door handle.
Figure 8B:
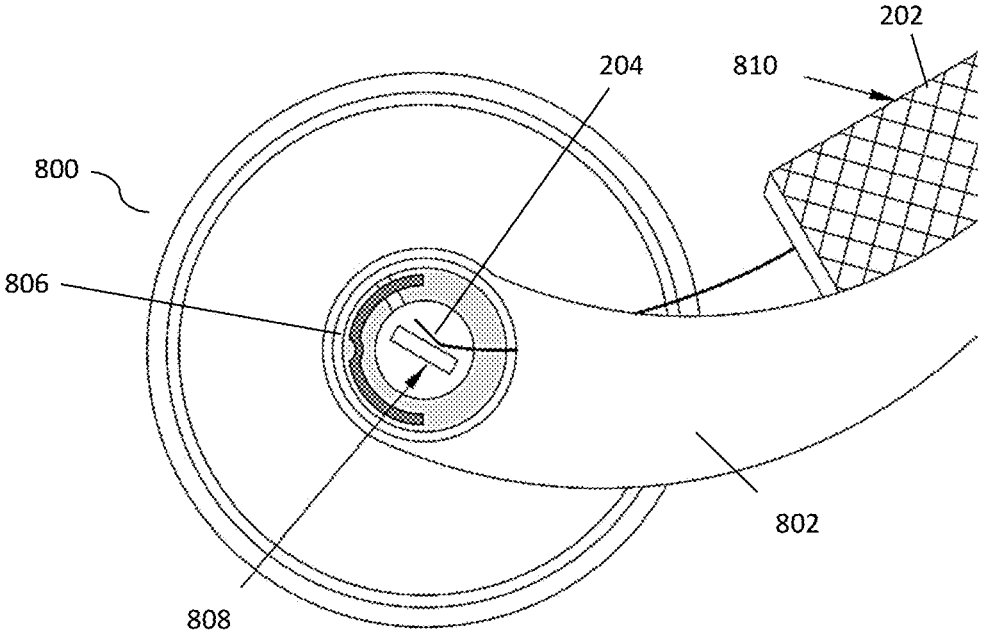
FIG. 8*b* is a perspective view of a tail piece manipulator engaging the tail piece of a tumbler in a door handle.

FIG. 8*a* is a perspective view of a tail piece manipulator inserted in an interior portion of a door handle with a tumbler lock 800 in a locked position; and, FIG. 8*b* is a perspective view of a tail piece manipulator engaging the tail piece of a door handle with a tumbler lock 800 to an unlocked position. Tumbler lock 800 is a single plate tumbler of a conventional cylinder lock in a door handle. According to an embodiment, tailpiece wire 204 of tailpiece manipulator 200 is inserted in an aperture 804 of a door handle with a tumbler lock 800 in a locked position, such that the tip of tailpiece wire 204 makes contact with tumbler 806. Once tailpiece wire 204 makes contact with tumbler 806, the user turns tailpiece manipulator 200 by applying rotational torque to handle 202 such that tailpiece wire 204 rotates tailpiece 808 to an unlocked position. Once tailpiece 808 is rotated to an unlocked position, the user can remove tailpiece wire 204 and rotate door handle 802.

Figure 9:
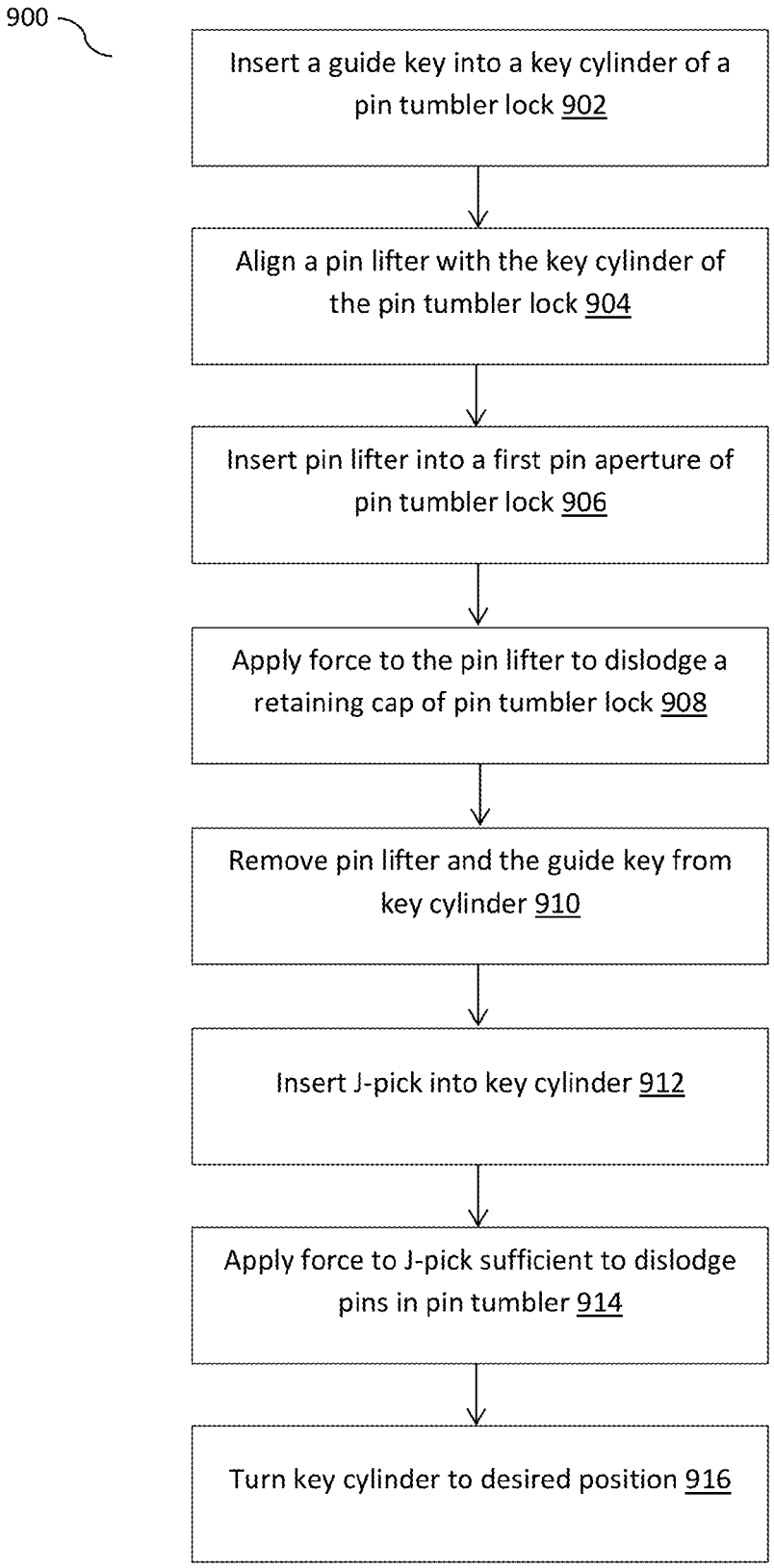
FIG. 9 is a logical flow diagram of a novel method for unlocking a pin tumbler lock.

FIG. 9 is a logical flow diagram of a method 900 for unlocking a pin tumbler lock. According to an embodiment, a user inserts a guide key into a key cylinder of a pin tumbler lock 902. The user then aligns a pin lifter with the key cylinder of the pin tumbler lock using the guide key 904. The user then inserts the pin lifter into a first pin aperture of pin tumbler lock by sliding the pin lifter against an inclined surface of the guide key 906. Once the pin lifter is inserted into the first pin aperture, the user applies force to the pin lifter to dislodge a retaining cap of pin tumbler lock 908. This is accomplished in preferred embodiments by striking a bottom portion of a handle of the pin lifter with a hammer. Once the retaining cap is dislodged, the user removes pin lifter and the guide key from key cylinder 910. The user inserts J-pick into key cylinder 912 and applies force to J-pick sufficient to dislodge pins in pin tumbler 914. Once the pins in the pin tumbler are dislodged, the user can turn key cylinder to desired position 916 to unlock the lock. To rekey the lock, the user can reset the pins, springs, and retaining cap in a desired position.

Figure 10:
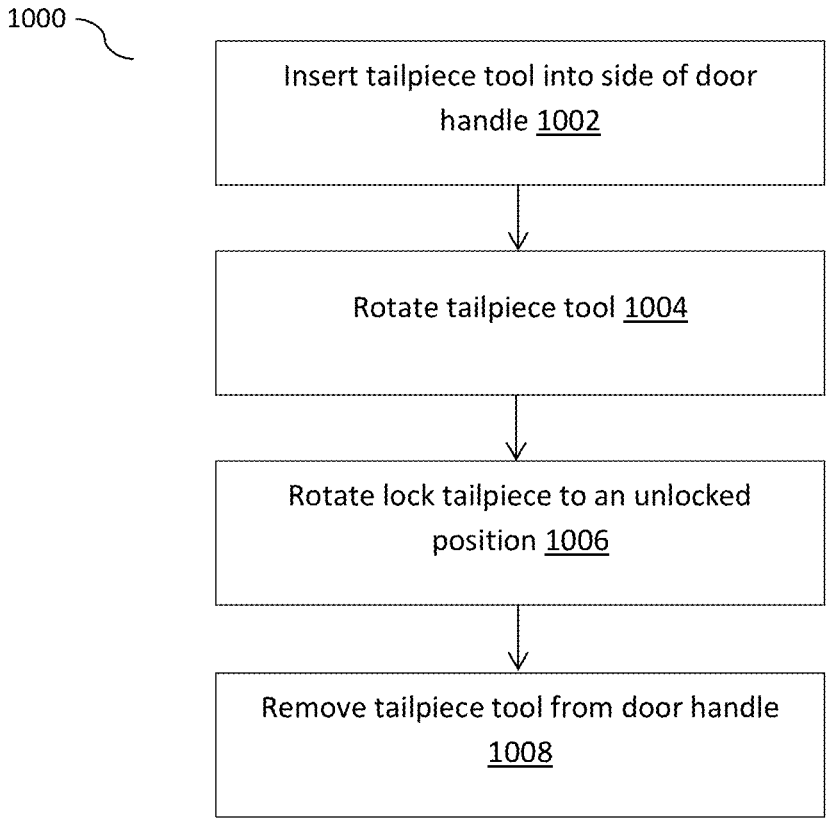
FIG. 10 is a logical flow diagram of a novel method for unlocking a door handle with a tumbler lock.

FIG. 10 is a logical flow diagram of a method 1000 for unlocking a door handle with a tumbler lock. According to an embodiment, a user inserts a tailpiece tool into an aperture on the side of door handle 1002 such that the tailpiece tool is in contact with a tumbler in the door handle. The user rotates tailpiece tool such that it is in contact with the tailpiece of the tumbler lock 1004 and rotates lock tailpiece to an unlocked position 1006. The user then removes tailpiece tool from door handle 1008 and rotates the door handle.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention.

What is claimed is:

1. A pin tumbler lock pick kit comprising:

a guide key apparatus, the guide key apparatus comprising:

an angled first surface, the angled first surface extending from a lower portion to an upper portion, a shoulder stop adjacent to an approximate midpoint of the angled first surface, the shoulder stop having a milling configured to align the upper portion of the angled first surface with a first pin aperture of a pin tumbler lock, and a key blade extending from the shoulder stop to a key tip, the key tip and the key blade having a substantially smooth upper surface, at least one side surface, and at least one milling disposed upon the at least one side surface, the at least one milling configured to align the key blade with a key cylinder of a pin tumbler lock;

a pin lifter apparatus comprising a substantially cylindrical handle having a top portion and a substantially flat bottom portion, and an elongated wire portion coupled to the top portion of the substantially cylindrical handle, the elongated wire portion having an angled tip;

a key head coupled to the angled first portion of the guide key apparatus, the key head and the angled first portion defining a notch; and, a pin remover apparatus having a handle portion and a substantially J-shaped pick.

2. A pin tumbler lock pick kit comprising:

a guide key apparatus, the guide key apparatus comprising:

an angled first surface, the angled first surface extending from a lower portion to an upper portion, a shoulder stop adjacent to an approximate midpoint of the angled first surface, the shoulder stop having a milling configured to align the upper portion of the angled first surface with a first pin aperture of a pin tumbler lock, and a key blade extending from the shoulder stop to a key tip, the key blade having a substantially smooth upper surface, at least one side surface, and at least one milling disposed upon the at least one side surface, the at least one milling configured to align the key blade with a key cylinder of a pin tumbler lock;

a key head coupled to the angled first portion of the guide key apparatus, the key head and the angled first portion defining a notch;

a pin lifter apparatus comprising a substantially cylindrical handle having a top portion and a substantially flat bottom portion, and an elongated wire portion coupled to the top portion of the substantially cylindrical handle, the elongated wire portion having an angled tip;

a pin remover apparatus having a handle portion and a substantially J-shaped pick; and, a tail piece manipulator apparatus having a handle portion and an elongated wire portion coupled to the handle portion.

3. A method of unlocking a pin tumbler lock, the method comprising:

inserting a guide key into a key cylinder of a pin tumbler lock, the guide key having an angled first surface extending from a lower portion to an upper portion, and a shoulder stop configured to align the upper portion of the angled first surface with a firt pin aperture of the pin tumbler lock, aligning a pin lifter with the key cylinder of the pin tumbler lock using the guide key, the pin lifter having an elongated wire portion, inserting the elongated wire portion of the pin lifter into the key cylinder in contact with the guide key, such that the elongated wire portion is inserted into the first pin aperture of the pin tumbler lock;

applying force to the pin lifter sufficient to dislodge a retaining cap of the pin tumbler lock;

removing the pin lifter and the guide key from the key cylinder;

inserting a substantially J-shaped pick into the key cylinder;

applying upward force to the substantially J-shaped pick sufficient to dislodge a plurality of lock pins in the pin tumbler lock; and, turning the key cylinder to a desired position.

* * * * *